US006739912B2

(12) United States Patent
Korsunsky et al.

(10) Patent No.: US 6,739,912 B2
(45) Date of Patent: May 25, 2004

(54) MODULAR JACK ASSEMBLY HAVING IMPROVED POSITIONING MEANS

(75) Inventors: Iosif R. Korsunsky, Harrisburg, PA (US); Kevin E. Walker, Hershey, PA (US); James H. Hyland, Hummelstown, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/232,879

(22) Filed: Aug. 29, 2002

(65) Prior Publication Data

US 2003/0087555 A1 May 8, 2003

Related U.S. Application Data

(63) Continuation-in-part of application No. 10/037,061, filed on Nov. 8, 2001, now Pat. No. 6,506,080.

(51) Int. Cl.[7] ..... H01R 13/66

(52) U.S. Cl. ..... 439/620; 439/676; 439/38; 439/76.1; 439/941

(58) Field of Search ..... 439/676, 76.1, 439/38, 620, 941

(56) References Cited

U.S. PATENT DOCUMENTS 6,537,110 B1 * 3/2003 Korsunsky et al. ..... 439/676

* cited by examiner

*Primary Examiner*—Truc Nguyen
(74) *Attorney, Agent, or Firm*—Wei Te Chung

(57) ABSTRACT

An electrical connector assembly (1) includes an insulating housing (2) and an electrical subassembly (3) disposed within the housing. The housing defines a receiving space (23) in a rear face (202), and at least one groove (26) and recess (28) extending in a back-to-front direction beside the receiving space. The electrical subassembly includes first and second printed circuit boards (320, 340) each having at least one side conductor (325, 345) attached thereon, a pair of magnetic modules (300, 300') respectively connecting with the first and second PCBs for suppressing noise, and a metal plate (4) sandwiched between the magnetic modules. The metal plate has at least one projection (48). When the electrical subassembly is assembled to the housing through the receiving space, the at least one side conductor and projection are respectively received in the at least one groove and recess, thereby ensuring the electrical subassembly being accurately inserted into the housing.

10 Claims, 10 Drawing Sheets

MODULAR JACK ASSEMBLY HAVING IMPROVED POSITIONING MEANS

CROSS-REFERENCE TO RELATED APPLICATIONS

This patent application is a continuation-in-part of U.S. patent application Ser. No. 10/037,061, filed on Nov. 8, 2001 now U.S. Pat. No. 6,506,080; and is related to U.S. patent applications entitled "STACKED MODULAR JACK ASSEMBLY HAVING BUILT-IN CIRCUIT BOARDS" (not filed yet), invented by the same inventors as this patent application, entitled "HIGH FREQUENCY MODULAR JACK CONNECTOR" (not filed yet), invented by the same inventors as this patent application; entitled "STACKED MODULAR JACK ASSEMBLY HAVING HIGHLY MODULARIZED ELECTRONIC COMPONENTS" (not filed yet), invented by the same inventors as this patent application; entitled "STACKED MODULAR JACK ASSEMBLY HAVING IMPROVED ELECTRIC CAPABILITY" (not filed yet), invented by the same inventors as this patent application, and all assigned to the same assignee with this application.

BACKGROUND OF THE INVENTION

1. Field of the Invention

The present invention relates to a modular jack assembly, and particularly to a stacked modular jack assembly having improved positioning means for facilitating assembling an electrical subassembly into an insulating housing thereof.

2. Description of Related Art

It is quite common to use modular jacks for the data transmission in high speed applications such as IEEE 802.3 10Base-T or 100Base-T local area networks. A common problem to these high speed modular jacks is their tendency to emit high frequency radiation. In order to allow only the necessary frequency bandwidth to pass for accurate communication, there is a need to provide means for suppressing undesirable noise.

Noise suppressors or signal conditioning components, such as common mode choke coils, are known in the art. The noise suppressors are mounted on a mother board on which the modular jack is seated. The noise suppressors are electrically connected with the modular jack by wires on the mother board. However, such signal conditioning components consume board real estate, which could otherwise be used for other circuitry. Furthermore, since the signal conditioning components are distant from the modular jack, the signal traces required to route the signals from the modular jack to the signal conditioning components degrade the signal integrity somewhat, thereby lowering the signal-to-noise ratio.

Stewart, headquartered in Glen Rock, Pa., posted an article, entitled "MagJack Family of Modular Jacks with Integrated Magnetics" on the Internet website address, http://www.stewartconnector.com/pdfs/magjkfypdf. This article introduces a series of magjack modular connectors each having integrated magnetic components housed within a jack body for protecting signals from internally and externally generated noise. Because the magnetic components are integrated into the jack itself, valuable board real estate is obviously saved.

U.S. Pat. No. 5,069,641, issued to Sakanmoto et al, discloses a modular jack assembly having an insulating housing and a printed circuit board assembly disposed within the housing. The printed circuit board assembly includes a printed circuit board containing common mode choke coils, and a plurality of contactors and terminals soldered with the printed circuit board. The contactors and terminals are electrically connected with the common mode choke coils by wires on the printed circuit board. The housing includes a base and a lid which are engaged by interlocked coupling. The base has a separator which divides the housing into first and second chambers. The printed circuit board with the common mode choke coils is mounted in the first chamber, and the contactors extend over the separator into the second chamber for engaging with a modular plug. The lid is then attached to the base, thereby encasing the printed circuit board assembly. However, because the housing is of two-piece configuration, positioning the printed circuit board assembly in the housing becomes complicated and time-consuming. In addition, due to different structure of the base and the lid, different molds are needed to manufacture them, thereby increasing the manufacturing cost.

U.S. Pat. Nos. 5,587,884 and 5,647,767, both assigned to The Whitaker Corporation, each disclose a modular jack assembly comprising an insulating housing and a printed circuit board assembly. The printed circuit board assembly includes a printed circuit board containing a choke coil for suppressing noise, and a plurality of terminals and leads soldered to the printed circuit board and electrically connected with the choke coil via traces on the printed circuit board. In order to position the printed circuit board assembly into the housing, an insert subassembly is employed. The insert subassembly includes front and rear insert members. The terminals are encapsulated in the front insert member. The leads and the printed circuit board are encapsulated in the rear insert member. The printed circuit board assembly can be positioned in the housing by partially inserting the insert subassembly into the housing. The front insert member has an interferential engagement with the housing. The rear insert member defines snap latches engaged with latches of the housing to hold the rear insert member in place. However, the insert subassembly is additionally fabricated for positioning the printed circuit board assembly, thereby increasing the manufacturing cost.

Hence, a modular jack assembly having improved positioning means is required to overcome the disadvantages of the prior art.

SUMMARY OF THE INVENTION

It is an object of the present invention to provide a modular jack assembly having improved positioning means for facilitating assembling an electrical subassembly into an insulating housing thereof.

It is another object of the present invention to provide a modular jack assembly having improved positioning means which can be easily formed, thereby saving the manufacturing cost.

In order to achieve the objects set forth, an electrical connector assembly in accordance with the present invention comprises an insulating housing and an electrical subassembly disposed within the housing. The housing defines a receiving space in a rear face, and a plurality of grooves and a pair of offsetting recesses extending in a back-to-front direction beside the receiving space. The electrical subassembly includes first and second printed circuit boards each having a pair of side conductors soldered on opposite edges thereof, a pair of magnetic modules respectively connecting with the first and second printed circuit boards for suppressing noise, and a metal plate sandwiched between the magnetic modules. The metal plate has a pair of offsetting projections on opposite side edges thereof. When the electrical subassembly is assembled to the housing through the receiving space, the side conductors and the projections are respectively received in the grooves and the recesses, thereby ensuring the electrical subassembly being accurately inserted into the housing.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
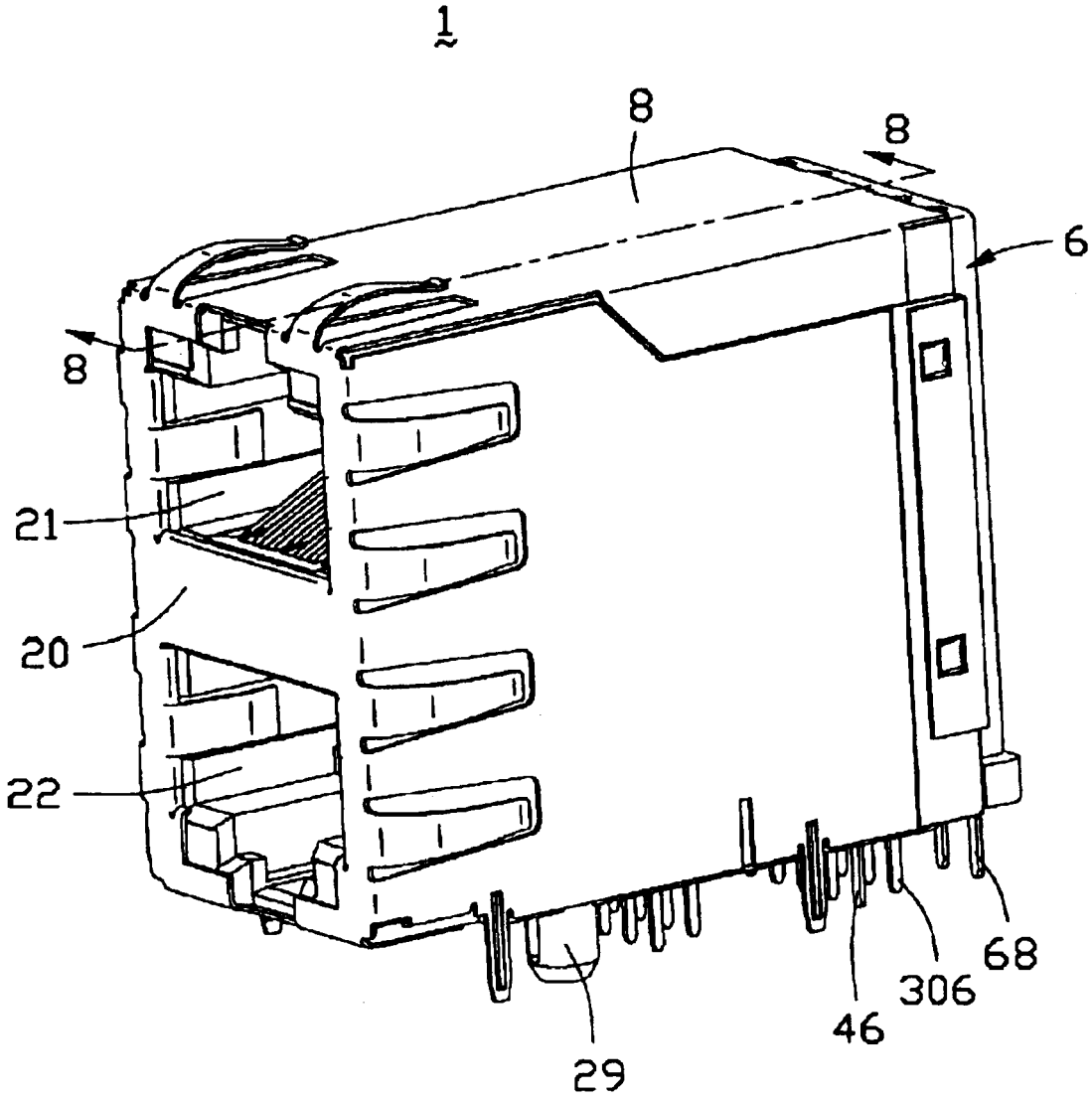
FIG. 1 is a perspective view of an electrical connector assembly in accordance with the present invention.
Figure 2:
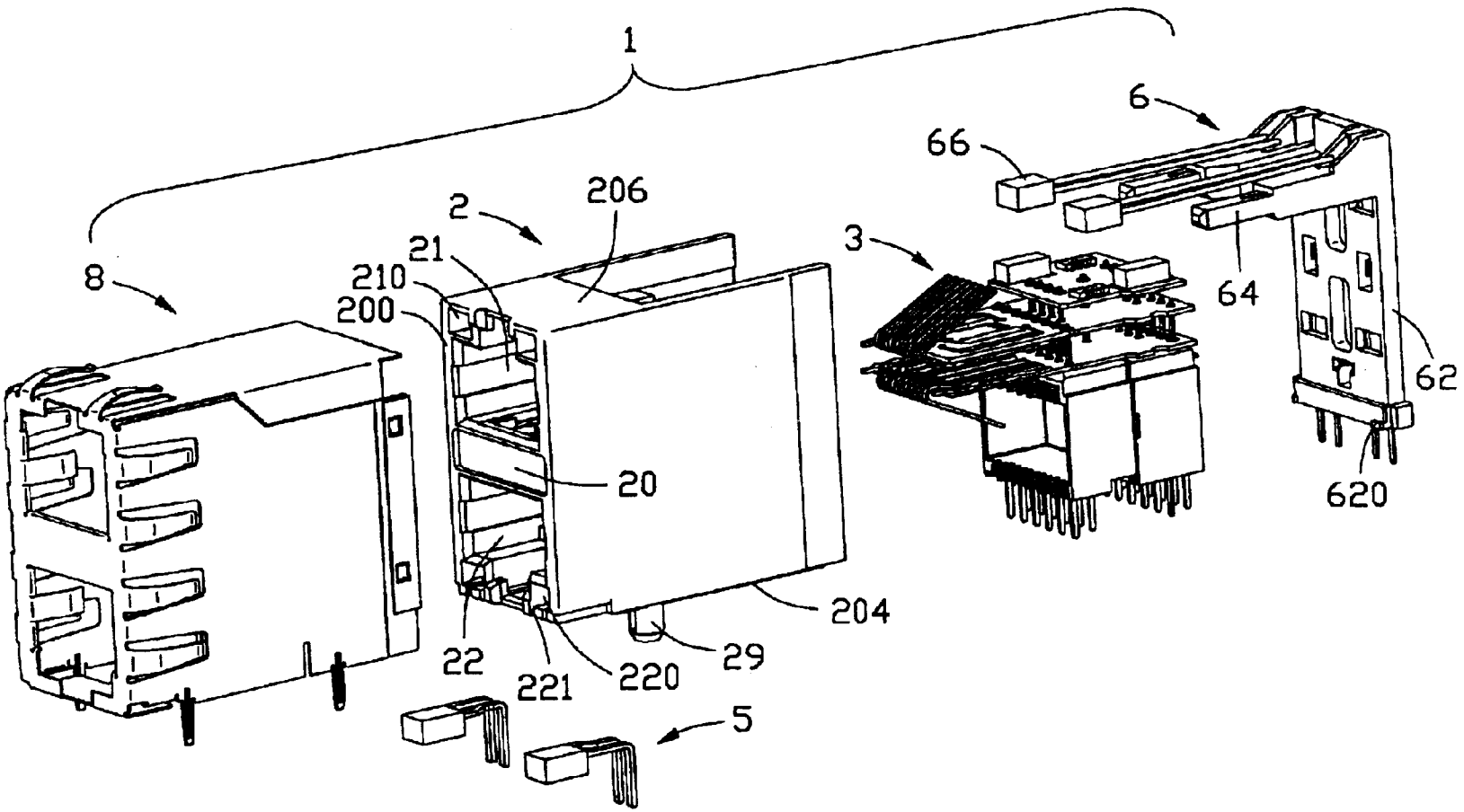
FIG. 2 is a front exploded view of the connector assembly of FIG. 1.

Referring to FIGS. 1 and 2, an electrical connector assembly 1 in accordance with the present invention comprises an insulating housing 2, an electrical subassembly 3 disposed within the insulating housing 2, an LED (Light-Emitting Diode) module 6 secured to the housing 2 for functioning as a visual indicator and a shell 8 optionally enclosing the housing 2 for EMI (Electromagnetic Interference) protection. In the preferred embodiment of the present invention, the electrical connector assembly 1 is a stacked LAN (Local Area Network) jack assembly for high speed signal transmission.

Figure 3:
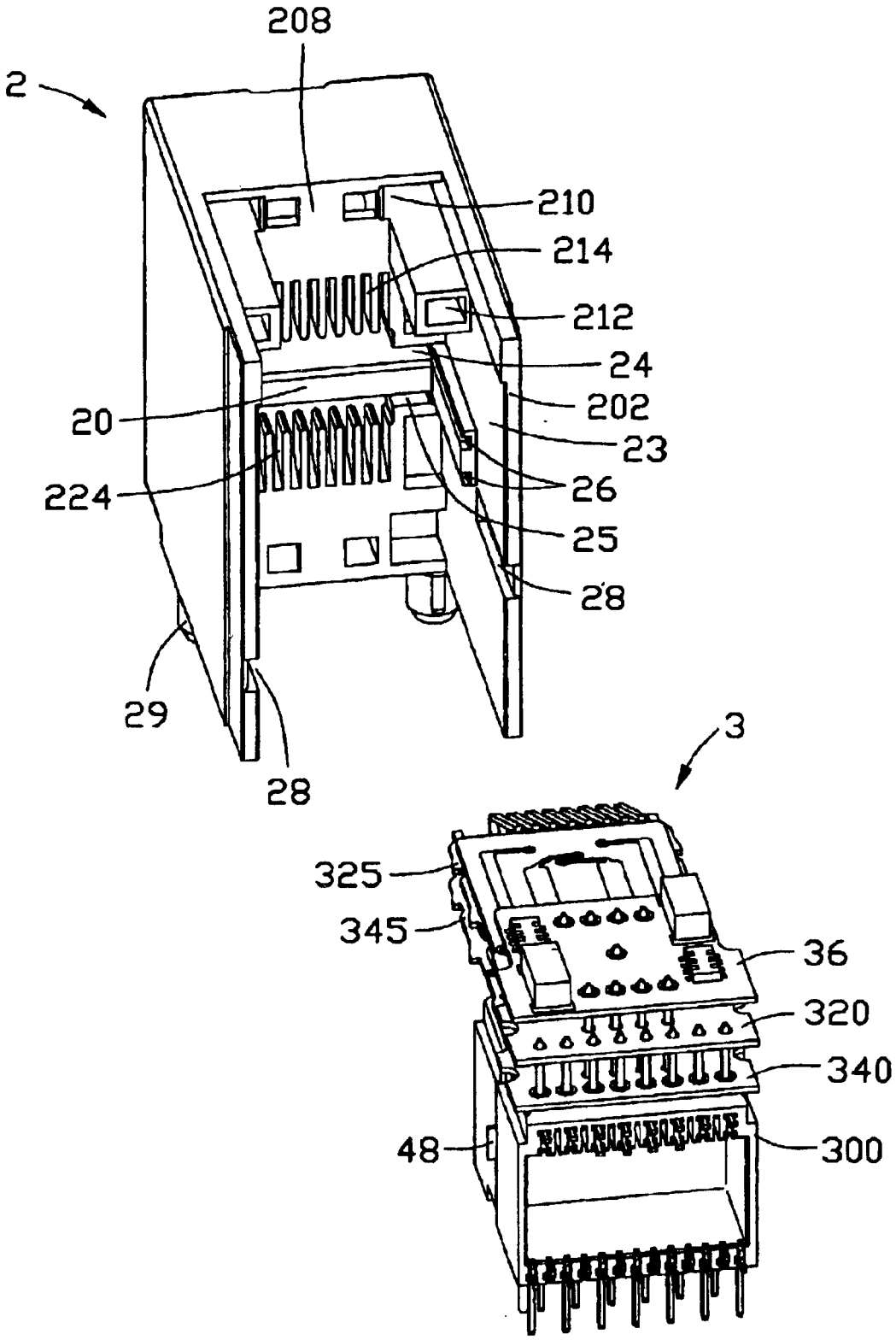
FIG. 3 shows an electrical subassembly of the present invention to be assembled into an insulating housing of FIG. 2.

Referring to FIG. 3, the insulating housing 2 defines upper and lower receiving cavities 21, 22 in a front mating face 200 for receiving modular plugs (not shown), and a receiving space 23 in a rear face 202 communicating with the upper and lower receiving cavities 21, 22 through upper and lower channels 24, 25. The upper and lower receiving cavities 21, 22 share a partition wall 20 therebetween and are arranged in a mirror-image manner.

The housing 2 defines a pair of upper and lower holes 210, 220 located at four corners of the front mating face 200. Each lower hole 220, near a bottom mounting face 204, extends into the housing 2 for a predetermined length for receiving therein a standard LED 5. The LED 5 is inserted into the corresponding lower hole 220 with its right-angled legs fitted in slits 221 formed in the bottom mounting face 204. Each upper hole 210, near a top face 206, extends in the housing 2 from the front mating face 200 to the receiving space 23. The housing 2 defines a plurality of upper and lower slits 214, 224 extending through an intermediate wall 208 between the receiving cavities 21, 22 and the receiving space 23.

The housing 2 defines two pairs of grooves 26 extending in a back-to-front direction of the housing 2 beside the receiving space 23. The grooves 26 extend into the upper and lower receiving cavities 21, 22 through the upper and lower channels 24, 25. The housing 2 further defines a pair of recesses 28 beside the receiving space 23 and offsetting from each other in a vertical direction. In addition, the housing 2 has a pair of positioning posts 29 downwardly extending from the bottom mounting face 204 for being received in corresponding holes of a mother board (not shown) on which the electrical connector assembly 1 is to be mounted.

Figure 5A:
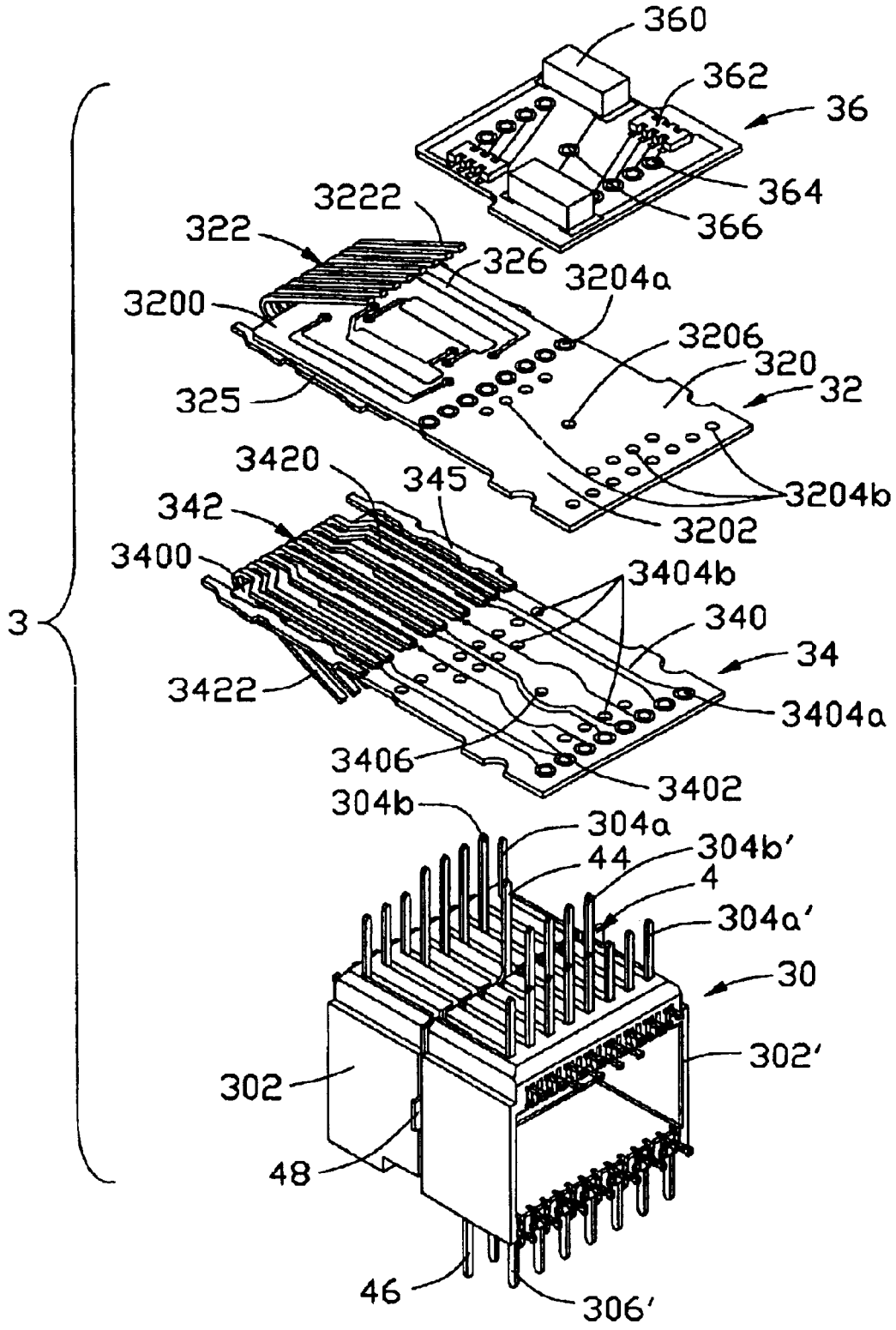
FIGS. 5*a* and 5*b* are exploded views of the electrical subassembly taken from different perspectives.
Figure 5B:
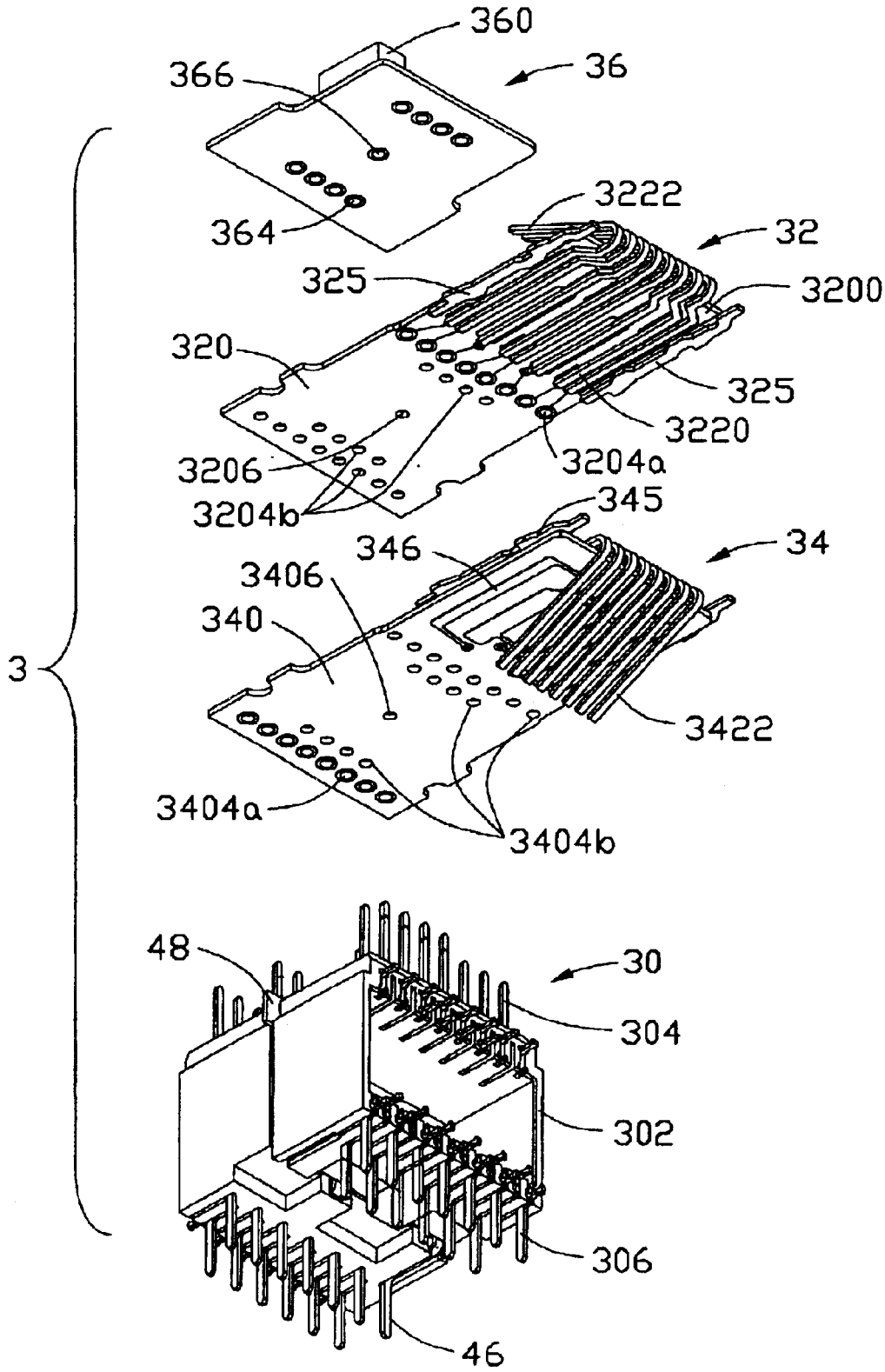

Referring to FIGS. 5*a* and 5*b* in conjunction with FIG. 2, the electrical subassembly 3 comprises a magnetic module assembly 30, upper and lower contact array assemblies 32, 34 positioned above the magnetic module assembly 30, and a third printed circuit board (PCB) 36 disposed above the upper contact array assembly 32.

Figure 6:
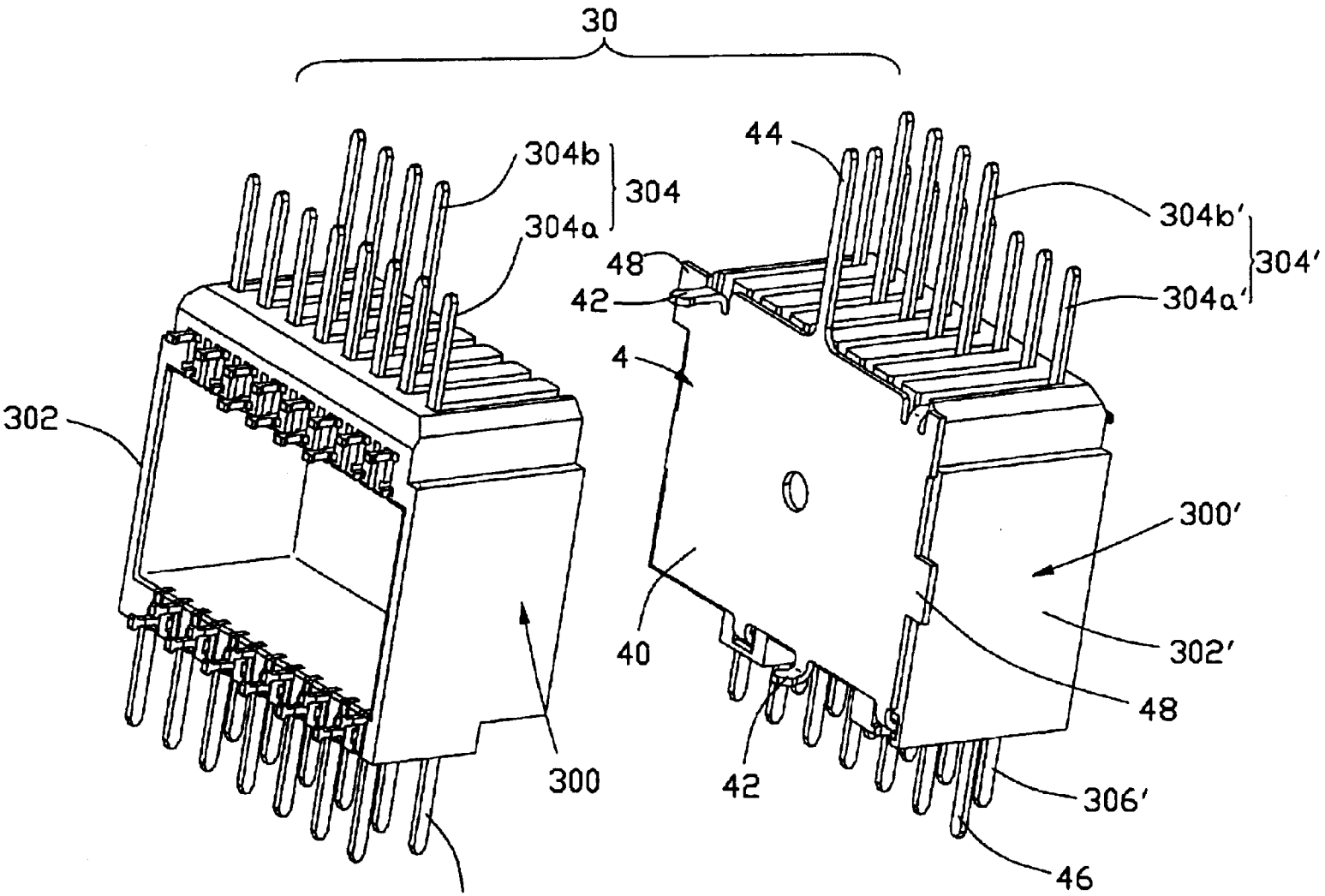
FIG. 6 is a partially exploded view of a magnetic module assembly of the present invention.
Figure 8:
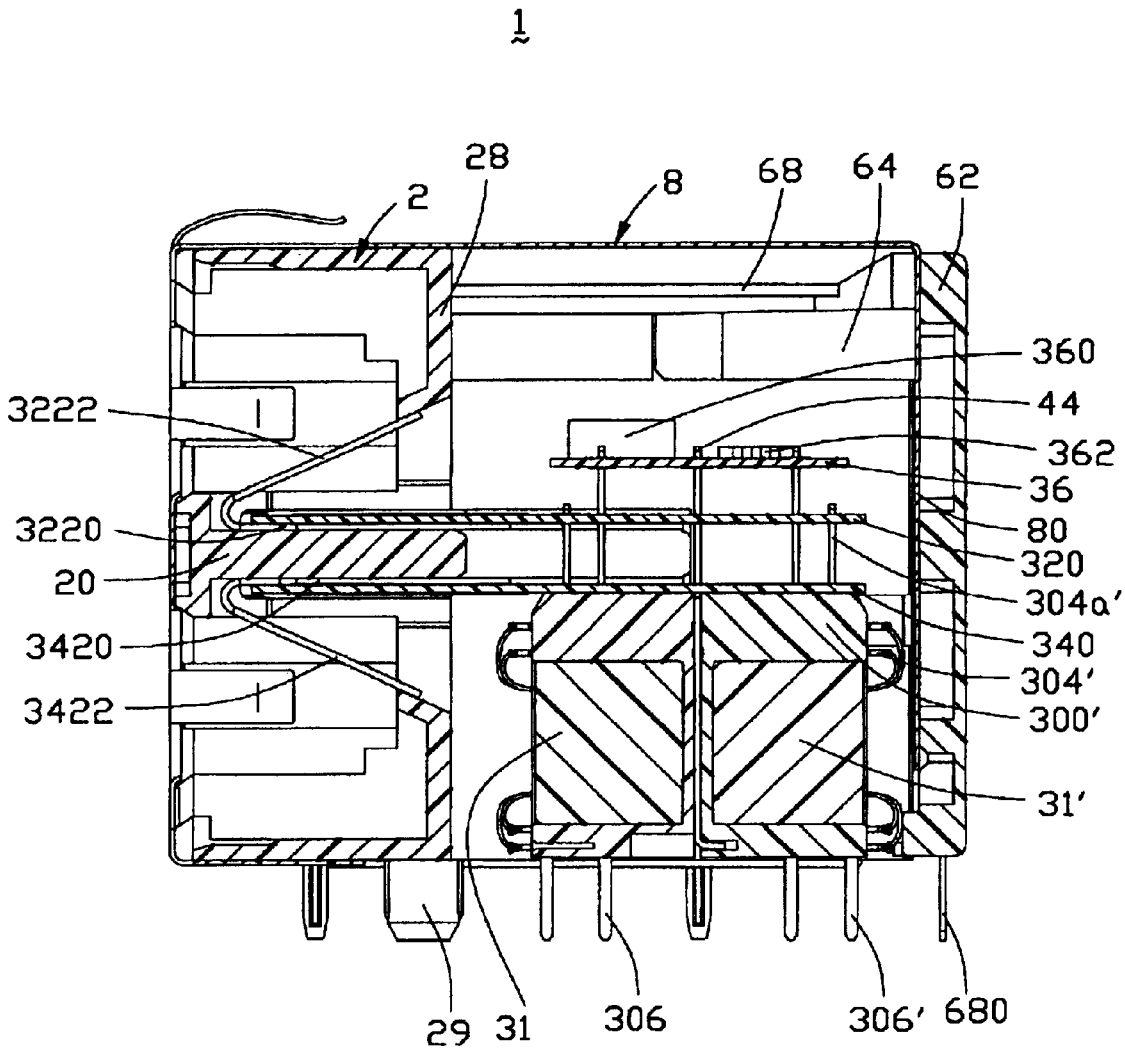
FIG. 8 is a cross-sectional view of the connector assembly taken along section line 8—8 of FIG. 1.

Referring to FIG. 6, the magnetic module assembly 30 includes front and rear magnetic modules 300, 300' located back to back and a metal plate 4 disposed between the front and rear magnetic modules 300, 300'. The front and rear magnetic modules 300, 300' are identical in structure. The front and rear magnetic modules 300, 300' each include a box 302 (302'), upper and lower pins 304, 306 (304', 306') respectively disposed on upper and lower portions of the box 302 (302'), and a plurality of magnetic coils 31 (31') housed within the box 302 (302') and connecting with the upper and lower pins 304, 306 (304', 306'), which is schematically shown in FIG. 8. The upper pins 304 (304') are divided into first and second pin arrays 304*a*, 304*b* (304*a*', 304*b*'). The metal plate 4 has a plane body 40 sandwiched between the front and rear magnetic modules 300, 300', and a plurality of tabs 42 extending forwardly and rearwardly from top and bottom edges of the plane body 40 and received in slots of the boxes 302, 302' for joining the front and rear magnetic modules 300, 300' together. Upper and lower legs 44, 46 respectively extend upwardly and downwardly from top and bottom edges of the plane body 40. The lower leg 46 is bent to form a right-angled tail aligned with the corresponding lower pins 306' of the rear magnetic module 300'. The metal plate 4 further forms a pair of offsetting projections 48 respectively on side edges thereof. The metal plate 4 electrically shield and isolate the front and rear magnetic modules 300, 300' for reducing crosstalk thereof.

Figure 7A:
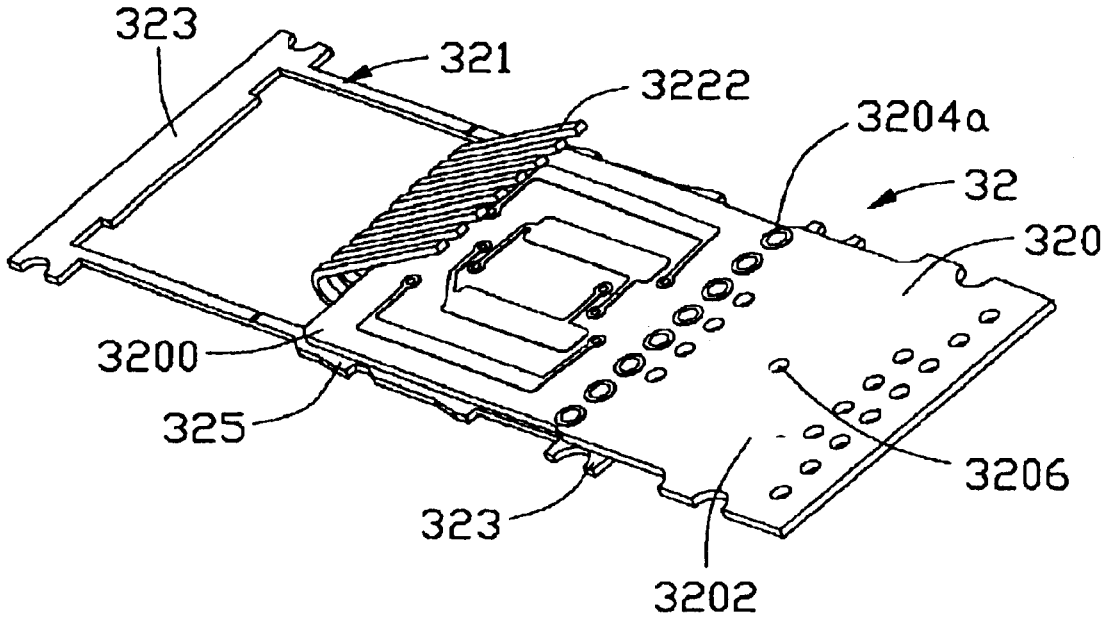
FIGS. 7*a* and 7*b* are perspective views of upper and lower contact array assemblies of the present invention with carriers not severed therefrom.
Figure 7B:
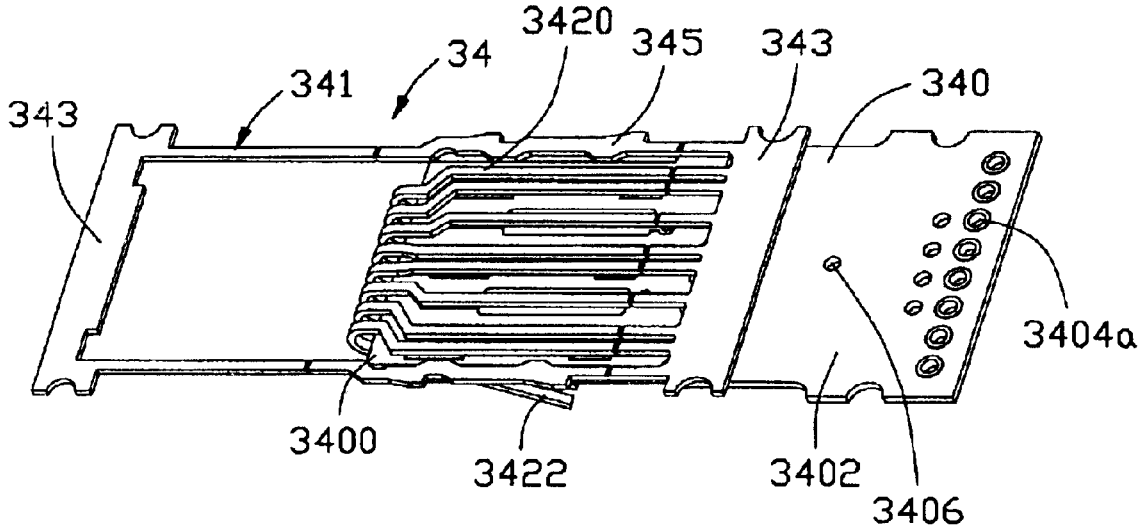

Referring to FIGS. 7*a* and 7*b* in conjunction with FIGS. 5*a* and 5*b*, the upper and lower contact array assemblies 32, 34 are identical in structure. The upper and lower contact array assemblies 32, 34 have respective first and second printed circuit boards (PCBs) 320, 340 and respective first and second contact strips 321, 341 soldered on the first and second PCBs 320, 340. The first and second contact strips 321, 341 include respective first and second contacts 322, 342, respective first and second side conductors 325, 345 each with barbs 3250, 3450 formed thereon and respective first and second carriers 323, 343. The first and second side conductors 325, 345 are respectively soldered on opposite side edges of the first and second PCBs 320, 340 and extended beyond respective first and second front edges 3200, 3400. The first and second contacts 322, 342 have respective first and second tail portions 3220, 3420 respectively soldered on solder pads of the first and second PCBs 320, 340, and first and second mating portions 3222, 3422 extending from the respective first and second tail portions 3220, 3420 and being angled rearwardly to be respectively located above and below upper and lower faces of the PCBs 320, 340 on which conductive traces 326, 346 (FIGS. 5*a* and 5*b*) are formed. The solder pads to which the first and second contacts 322, 342 are soldered, and the conductive traces 326, 346 are so designed and arranged that they can eliminate cross-talk between the first contacts and the second contacts 342, respectively. The related description of the solder pads and the conductive traces on the first and second PCBs 320, 340 are disclosed in patent application Ser. No. 10/037,061 filed on Nov. 8, 2001, and entitled "RJ MODULAR CONNECTOR HAVING SUBSTRATE HAVING CONDUCTIVE TRACE TO BALANCE ELECTRICAL COUPLINGS BETWEEN TERMINALS". The disclosures of the '061 application are wholly incorporated herein by reference.

The first and second PCBs 320, 340 define first and second plated through holes 3204*a*, 3404*a* and first and second clear through holes 3204*b*, 3404*b* at respective first and second rear portions 3202, 3402, and respective first and second clear apertures 3206, 3406 therein.

The third PCB 36 contains a plurality of signal conditioning components such as capacitors 360 and resistors 362 used for signal conditioning and termination. The third PCB 36 defines a plurality of third plated through holes 364 and a third plated aperture 366 therein.

The first upper pin array 304*a*' of the rear magnetic module 300' is soldered to the second plated through holes 3404*a* of the second PCB 340 and electrically connected with the second contacts 342 by wires (not labeled) on the second PCB 340. The first upper pin array 304*a* of the front magnetic module 300 first penetrates through the second clear through holes 3404*b* and then are soldered to the first plated through holes 3204*a* of the first PCB 320 and electrically connected with the first contacts 322 by wires (not labeled) on the first PCB 320. The second upper pin arrays 304*b*, 304*b*' of the front and rear magnetic modules 300, 300' penetrate through the second and first clear through holes 3404*b*, 3204*b* to be soldered to the third plated through holes 364 of the third PCB 36. At the same time, the upper leg 44 of the metal plate 4 penetrates through the second and first clear apertures 3406, 3206 of the second and first PCBs 340, 320 to be soldered to the third plated aperture 366 of the third PCB 36.

It can be seen that when the modular jack assembly 1 engages with the modular plugs, noise received through the first and second contacts 322, 342 is respectively reduced by the magnetic coils 31, 31' of the front and rear magnetic modules 300, 300'.

It is noted that the second upper pin arrays 304*b*, 304*b*' of the front and rear magnetic modules 300, 300' are connected to the capacitors 360 and the resistors 362 via circuit traces (not labeled) on the third PCB 36. The third plated through hole 366 is defined in the circuit trace of the third PCB 36, and the upper and lower legs 44, 46 of the metal plate 4 function as grounding terminals for respectively soldering with the third PCB 36 and the mother board. A majority of the upper and lower pins 304, 306 (304', 306') are connected with each other through the magnetic coils 31 (31'). The signals in the first and second contacts 322, 342 are conditioned by the capacitors 360 and the resistors 362 on the third PCB 36.

Figure 4:
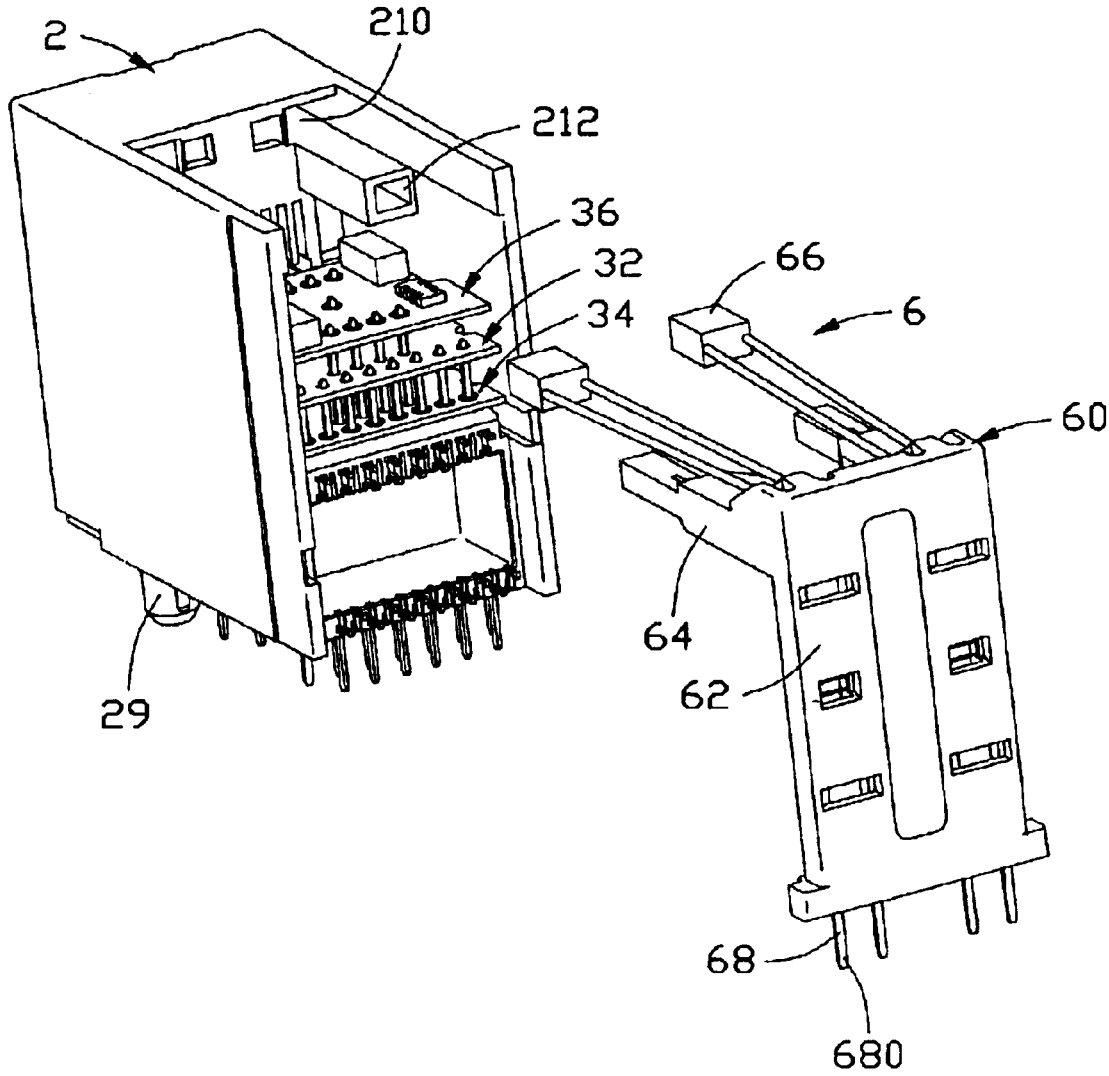
FIG. 4 is a partially assembled view of the connector assembly showing the electrical subassembly disposed within the insulating housing and an LED module to be assembled within the insulating housing.

Referring to FIGS. 2 and 4, the LED module 6 includes an insulating carrier 60 with leads 68 overmolded therein and a pair of standard LEDs 66 electrically connecting with the leads 68. The carrier 60 has a base portion 62 and a pair of limbs 64 forwardly perpendicularly extending from a top edge of the base portion 60. The leads 68 have legs 680 downwardly extending beneath a bottom edge of the base portion 62 for soldering to the mother board.

Referring to FIG. 3, the electrical subassembly 3 is inserted into the housing 2 through the receiving space 23 in the rear face 202. The first and second PCBs 320, 340 of the upper and lower contact array assemblies 32, 34 move forwardly respectively through the upper and lower channels 24, 25 of the housing 2 until the first and second mating portions 3222, 3422 of the first and second contacts 322, 342 respectively extend into the upper and lower receiving cavities 21, 22 through the upper and lower slits 214, 224. The first and second rear portions 3202, 3402 of the first and second PCBs 320, 340, the magnetic module assembly 30 and the third PCB 36 are disposed in the receiving space 23. During this procedure, the first and second side conductors 325, 345 on the first and second PCBs 320, 340 are received in the corresponding grooves 26 for positioning the electrical subassembly 3 in a horizontal direction. At the same time, an interengaged device is defined between the housing 2 and the electrical subassembly 3 for positioning the electrical subassembly 3 in a vertical direction. In the preferred embodiment of the present invention, the interengaged device includes the pair of offsetting projections 48 of the metal plate 4 and the offsetting recesses 28 of the housing 2. The pair of offsetting projections 48 is received in the offsetting recesses 28 of the housing 2. Thus, the electrical subassembly 3 is ensured to be accurately inserted into the housing 2. Finally, the barbs 3250, 3450 of the first and second side conductors 325, 345 have an interferential engagement with the housing 2 in the grooves 26.

Although the preferred embodiment of the present invention only discloses an electrical subassembly used in a dual-port modular jack, it can be understood that a single-port modular jack can be constructed by modifying the electrical subassembly of the dual-port modular jack by removing one contact array assembly and one magnetic module therefrom. The interengaged device for positioning the electrical subassembly in a vertical direction is defined between an electronic component and an insulating housing of the single-port modular jack. In the preferred embodiment of the present invention, the electronic component includes a magnetic module and a metal plate attached on the magnetic module.

It can be understood that the first and second carriers 323, 324 of the first and second contact strips 321, 341 can be removed just before the electrical subassembly 3 is assembled to the housing 2.

The shell 8 then encloses the housing 2 for EMI protection. The LED module 6 is finally secured to the housing 2 in a back-to-front direction. The LEDs 66 are inserted into the upper holes 210 of the housing 2 and can be visible from the front mating face 200. The limbs 64 are received in slots 212 (FIG. 3) defined below the upper holes 210 of the housing 2. The base portion 62 abuts against a rear wall 80 (FIG. 8) of the shell 8 with protrusions 620 (FIG. 2) keying into the housing 2.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A modular jack assembly comprising:

an insulating housing defining in a front mating face first and second receiving cavities, and a receiving space in a rear face communicating with the first and second receiving cavities, the housing further defining at least one recess beside the receiving space; and an electrical subassembly assembled to the housing, comprising:

first and second contact array assemblies each having a plurality of contacts, the contacts having mating portions respectively projecting into the first and second receiving cavities for engaging with modular plugs;

a pair of magnetic modules electrically connecting with the contacts of the first and second contact array assemblies, respectively; and a metal plate sandwiched between the magnetic modules and having at least one projection;

wherein when the electrical subassembly is inserted into the receiving space of the housing, the at least one projection is received in the at least one recess of the housing for accurately positioning the electrical subassembly.

2. The modular jack assembly as claimed in claim 1, wherein the at least one recess of the housing has two recesses, and the at least one projection has two projections formed on opposite side edges of the metal plate for being received in the recesses.

3. The modular jack assembly as claimed in claim 1, wherein each contact array assembly includes a printed circuit board, and the contacts are soldered on the printed circuit board.

4. The modular jack assembly as claimed in claim 3, wherein the housing defines a pair of grooves beside the receiving space, and the printed circuit board has a pair of side conductors attached on opposite edges thereof, the side conductors being received in the grooves of the housing for further positioning the electrical subassembly.

5. The modular jack assembly as claimed in claim 4, wherein the side conductors have barbs formed thereon, the barbs having an interferential engagement with the housing in the grooves.

6. The modular jack assembly as claimed in claim 1, wherein each magnetic module includes a box, upper and lower pins respectively disposed on upper and lower portions of the box, and magnetic coils in the box connecting with the upper and lower pins.

7. The modular jack assembly as claimed in claim 6, wherein the magnetic modules are electrically connected with the contacts of the first and second contact array assemblies via some of the upper pins.

8. The modular jack assembly as claimed in claim 7, wherein the metal plate has upper and lower legs respectively extending upwardly and downwardly from top and bottom edges thereof.

9. The modular jack assembly as claimed in claim 8, wherein the electrical subassembly further includes a third printed circuit board connecting with the magnetic modules and the metal plate respectively via the others of the upper pins of the magnetic modules and the upper leg of the metal plate.

10. The modular jack assembly as claimed in claim 9, wherein the third printed circuit board has a plurality of capacitors and resistors thereon.

* * * * *